United States Patent [19]

Logan, 3rd.

[11] 4,290,643

[45] Sep. 22, 1981

[54] FOLDING CHAIR

[76] Inventor: William F. Logan, 3rd., 1329 Marlborough Ave., Plainfield, N.J. 07060

[21] Appl. No.: 6,782

[22] Filed: Jan. 26, 1979

[51] Int. Cl.[3] ..... A47C 4/28

[52] U.S. Cl. ..... 297/16; 297/441; 297/457

[58] Field of Search ..... 297/440, 441, 16, 457; 248/431, 435; 108/128

[56] References Cited

U.S. PATENT DOCUMENTS

| | | | |
|---|---|---|---|
| 487,469 | 12/1892 | Burgess | 182/22 |
| 2,139,673 | 12/1938 | Draper | 108/128 |
| 2,689,602 | 9/1954 | Morgan | 297/441 |
| 2,691,410 | 10/1954 | Boucher | 297/57 X |
| 2,702,586 | 2/1955 | Borgfeldt | 297/441 |
| 2,713,529 | 7/1955 | Herrschaft | 248/431 |
| 3,199,825 | 8/1965 | Bellows | 248/171 |
| 3,292,946 | 7/1967 | Stromberg | 108/128 X |
| 3,351,376 | 11/1967 | Shimizu | 297/457 |
| 4,148,520 | 4/1979 | Miller | 297/441 |

FOREIGN PATENT DOCUMENTS

| | | | |
|---|---|---|---|
| 361633 | 10/1922 | Fed. Rep. of Germany | 108/128 |
| 2730209 | 1/1978 | Fed. Rep. of Germany . | |

*Primary Examiner*—Francis K. Zugel
*Attorney, Agent, or Firm*—Ladas & Parry

[57] ABSTRACT

A folding chair is formed of an integral tensile structure having eight articulated compression members with inner ends transfixed by a central ring. The outer ends of the compression members are joined by cables and a concave fabric seat to hold the chair in a usable position, one cable being released to collapse and fold the chair. To maintain the orientation of the ring on unfolding the chair, the inner ends of two compression members have engaged teeth formed thereon.

3 Claims, 5 Drawing Figures

FOLDING CHAIR

This invention relates to seating structures and is particularly concerned with lightweight and compactly folding chairs wherein the support elements, when the chair is folded, are brought together into a close parallel relationship, the seat back, arms, and base being composed of a fabric or similar flexible material.

Several designs for lightweight folding chairs currently exist in which the support elements, when folded, are brought together into a substantially parallel arrangement with the seat being composed of a flexible fabric or other material. Existing chairs of this category have the disadvantage of creating a relatively long bundle of support elements when folded, resulting from their use of long, continuous structural elements to support the chair back. A further disadvantage of existing designs employing fabric seats lies in their use of a seat membrane which hangs from the support structure in a limp manner, and as a result, does not give positive support to the occupant's lower back and which can also cut into the bottom of the occupant's thighs.

It is an object of this invention to create a lightweight seating structure which can be folded into a reduced volume for transportation and storage.

It is a further object of this invention to create a chair utilizing this seating structure, which can provide improved support for the back, arms, and legs of the occupant.

A still further object is to create a seating structure which will be much lighter than comparable folding chairs now in use.

The invention realizes the above objects by providing a folding frame in which the supporting elements are pivoted about a central connector in such a way as to permit them to lie in a parallel bundle of reduced length and diameter when the chair is folded. These support elements are stabilized in relation to one another by the provision of a series of collapsible tension members which work in conjunction with the tensioned fabric seat, to achieve a relatively rigid and fully braced seating structure. The fabric seat element becomes prestressed and suitably curved to provide support for the occupant's body as a result of the multiple directions in which the fabric seat material is pulled before being loaded with the weight of a person.

The invention realizes the object of being of greatly reduced weight by loading the majority of the support elements in tension and by reducing the number and length of support elements loaded in compression to a minimum, with only minor connectors loaded in bending.

Referring to the accompanying drawings.

In a preferred embodiment of the invention, the compression members are constructed from lengths of lightweight metal tubing, the tension members are constructed from wire cable and the seat element constructed from a flexible fabric material with continuous reinforcing along all edges, such as rope or webbing. It is this reinforcement at the fabric edges which permits the applied loads on the chair to be concentrated into the corners of the seat material and redirected into the supporting compression and tension members.

Figure 1:
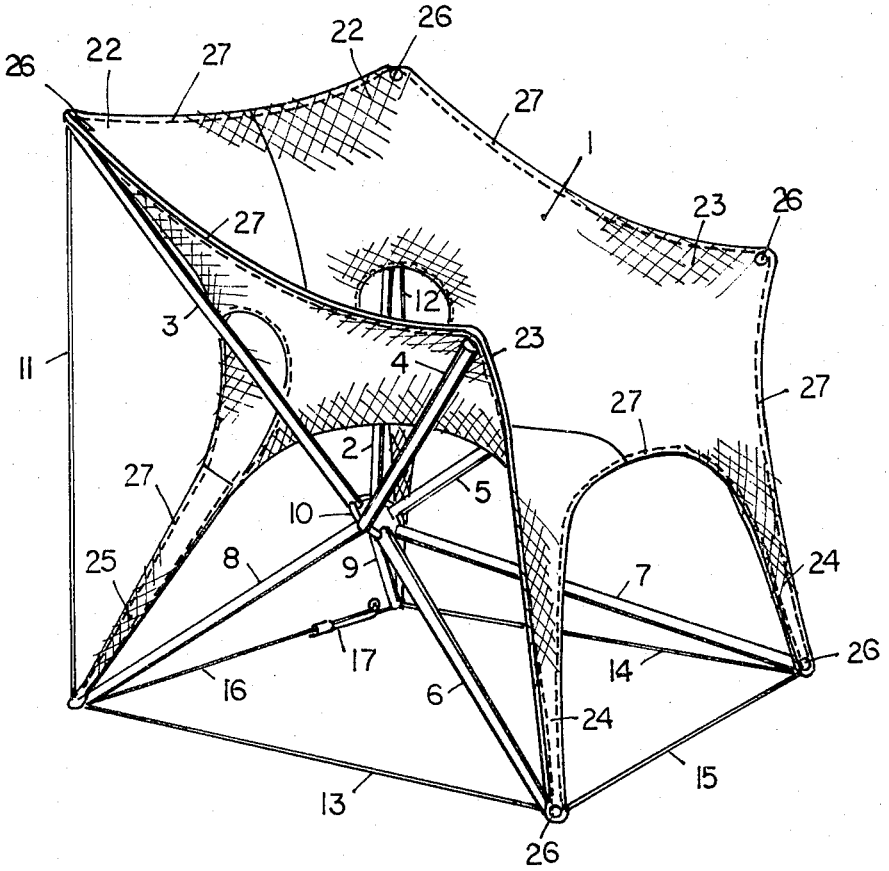
FIG. 1 is a perspective view of the chair.

Referring now more specifically to the drawings, in FIG. 1, the back corners 22, of the collapsible seat material 1, are attached by suitable corner connectors 26, to the outer ends of the upwardly and rearwardly extending compression members 2 and 3; the forward corners of the arms portion of the seat material 23, are attached by corner connectors 26 to the outer ends of the upwardly and forwardly extending compression members 4 and 5; the forward lower leg portion of the seat material or its extensions 24, are attached by similar corner connectors 26, to the ends of the forwardly and downwardly extending compression members 6 and 7; and finally the extensions of the rear lowermost part of the seat 25, are suitably attached to the ends of the downwardly and rearwardly extending compression members 8 and 9, pulling the seat material into an antielastically curved surface capable of providing firm support for an occupant.

The edges of the seat material are strengthened by a continuous edge reinforcement 27, and cut in a catenary profile enabling the initial prestressing force shaping the seat material and the applied load of the occupant to be redirected and applied to suitable corner connectors 26, fixing the seat material to the end of the compression members. This corner connector may be of a removeable type permitting the seat material to be easily replaced or cleaned.

Figure 2:
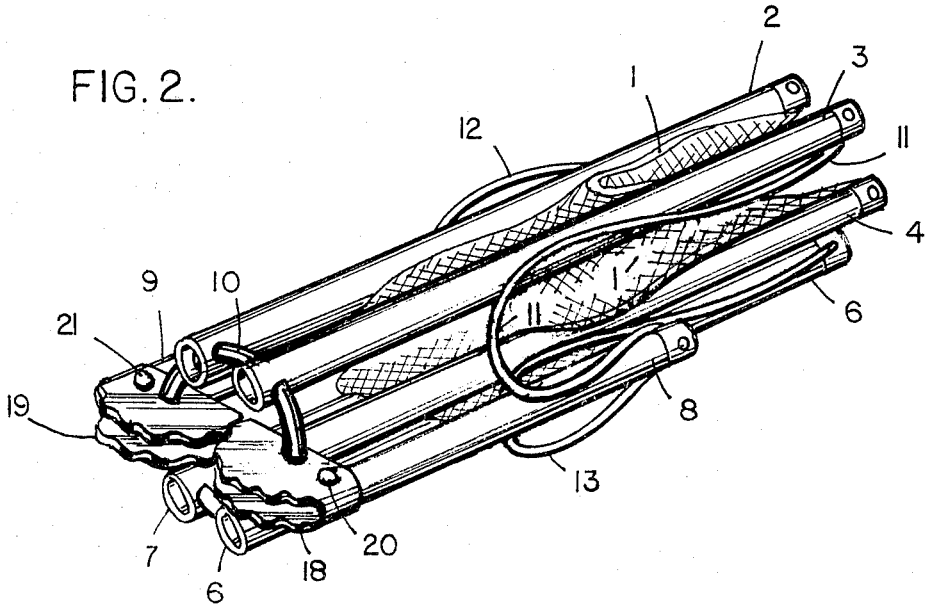
FIG. 2 is a perspective view of the chair in the folded position.
Figure 3:
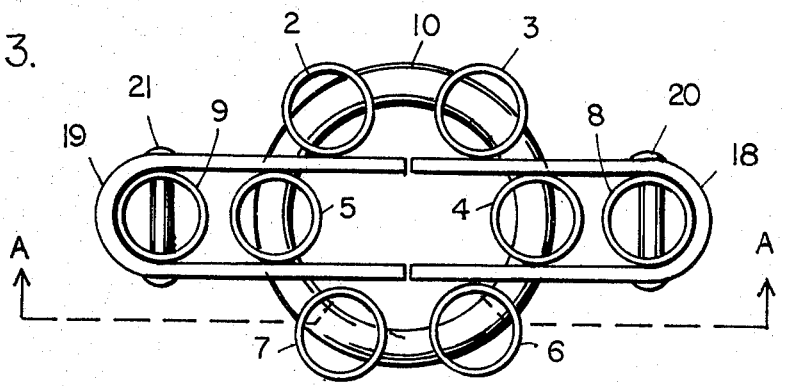
FIG. 3 is a detail plan view of the central connector.
Figure 4:
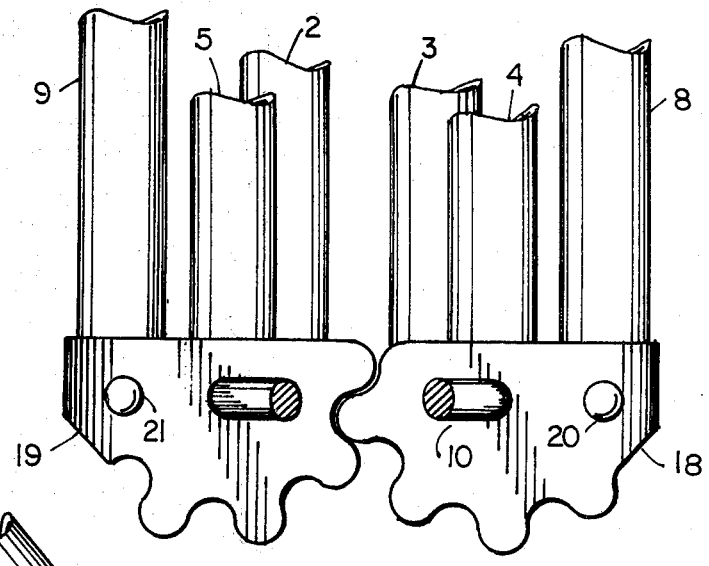
FIG. 4 is a partial elevation, partial section taken on the line AA fof FIG. 3 illustrating the compression members, connector plates, and connector ring.
Figure 5:
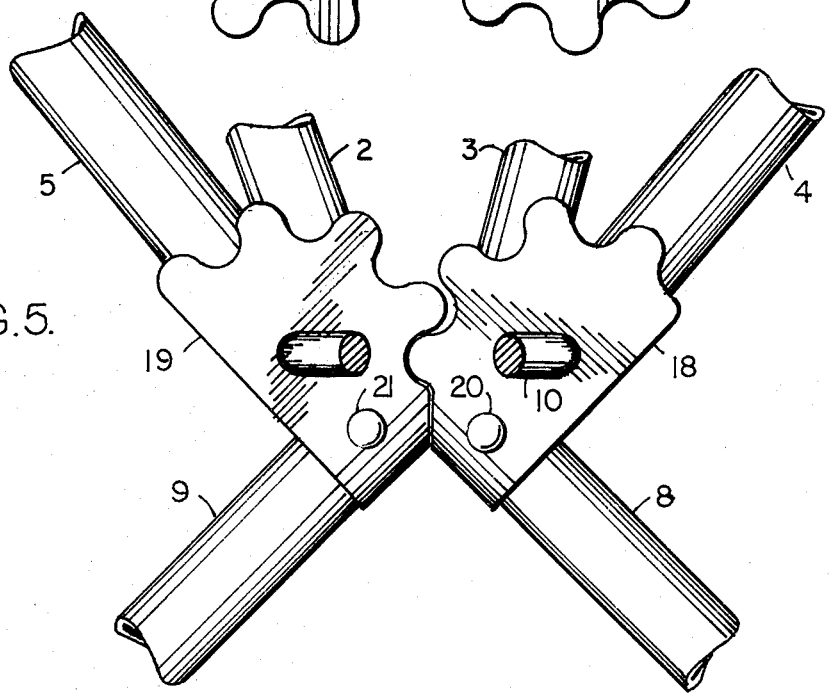
FIG. 5 is a partial elevation, partial section taken on line AA of FIG. 3 illustrating the compression members, connector plates, and connector ring in the unfolded position.

The stability of the compression elements and seat material is achieved by means of flexible tension members 11, 12, 13, 14, 15, 16, linking the ends of these compression members. In the preferred embodiment, this is achieved using two separate lengths of wire cable. One of these lengths, taken together as 11, 13, 15, 14, 12, has one end suitably attached to the outer end of compression member 3, then passes through a suitable fixing in the end of compression member 8, passes in turn through suitable fixings in the outer ends of compression members 6, then 7, then 9, and has its other end suitably attached to the outer end of compression member 2. A second length of cable 16, has one of its ends suitable attached to the outer end of compression member 8, and its other end fixed to a detachable means 17, which links it to the outer end of compression member 9. This detachable means connecting rear tension member 16 to compression member 9 may be a turnbuckle or a lever-action device connected to a hook or eye on the outer end of compression member 9. It is by means of this detachable device 17, that tension may be applied to the elements composing the chair structure, and by means of which tension may be released, permitting the compression elements to hinge about the central connector 10, into a parallel folded configuration as illustrated in FIG. 2. FIGS. 3, 4, and 5 illustrate in detail the manner in which the compression members may be attached to the central ring connector 10. In the partial elevations shown in FIGS. 4 and 5, the compression members 6 and 7 are omitted for the sake of clarity. In a preferred embodiment, compression members 2, 3, 4, 5, 6, and 7 are pivotally connected to a metal connector ring 10, by means of apertures in their inner ends through which the ring passes. The two rearwardly and downwardly extending compression members 8, 9, are pivotally connected to ring 10 by means of connector plates 18, 19 (omitted from FIG. 1 for the sake of clarity) to which they are in turn rigidly attached by suitable fixing means 20, 21, such as a rivet. These connector plates, being formed of metal, enable the two rearwardly and downwardly extending compression members 8, 9, to remain in a fixed relationship to one another and to the connector ring 10, thereby creating a stiff triangulated configuration with rear tension member 16, on which the central ring connector 10 may be fixed so as to prevent it from skewing out of its plane of support for the remaining compression members. One preferred method of maintaining the correct alignment of compression members 8 and 9 is to form engaging teeth on their respective connector plates 18 and 19. The forwardly and upwardly extending compression members 4 and 5 are free to rotate on connector ring 10 within the above mentioned connector plates 18, 19.

The relative lengths of compression members and tension members in conjunction with the proportions of the seat material may be altered to achieve various types and sizes of chairs without departing from the principles and methods herein described.

I claim:

1. A folding chair formed of an integral support structure comprising, in combination, a central connection ring, eight compression members having inner ends pivotally connected to said central connection ring and outer ends, a first and a second of said compression members having their inner ends pivotable on said ring and extending forwardly and downwardly, a third and a fourth of said compression members having their inner ends pivotable on said ring about axes which coincide with the axes of pivotal connection to the ring of the first and second compression members, extending rearwardly and downwardly, said outer ends of said downwardly extending compression members resting on the floor, a fifth, a sixth, a seventh and an eighth of said compression members having their inner ends pivotable on said ring and extending upwardly and having outer ends generally above the outer ends of said downwardly extending compression members, the fifth and sixth compression members extending forwardly and in a common plane with the third and fourth compression members, said common plane being perpendicular to the plane of the ring, and the seventh and eighth compression members extending rearwardly, four collapsible tension members connecting the outer ends of said downwardly extending compression members and two generally vertical collapsible tension members connecting the outer ends of said rearwardly extending compression members, a seat of collapsible sheet material having a back edge connected between the outer ends of said rearwardly and upwardly extending compression members, and side edges forming arms each connected between the outer ends of an upwardly and rearwardly extending compression member and an upwardly and forwardly extending compression member, said seat being concave, collapsible means connecting the outer end of each forwardly and downwardly extending compression member to the outer end of the forwardly and upwardly extending compression member thereabove, and means disconnecting the collapsible tension member which connects the third and fourth compression members so that said compression members pivot together about said central connection ring folding said chair, and wherein the inner ends of the third and fourth compression members are each provided with respective toothed inward extensions which interengage at opposite sides of the inner ends of the third, fourth, fifth and sixth compression members to restrict pivotal movement to said common plane, whereby the ring is stabilized against tilting about diametrical axes thereof, and said collapsible means connecting the outer ends of each forwardly and downwardly extending compression member to the outer end of the forwardly and upwardly extending compression member thereabove is a forward extension of said seat, said forward extensions of said seat being connected to said outer ends of said forwardly and downwardly extending compression members.

2. The combination according to claim 1 wherein said means disconnecting one of said collapsible tension members disconnects said collapsible tension member connecting the outer ends of said downwardly and rearwardly extending compression members.

3. The combination according to claim 2 wherein said central connection is a ring, and at least some of said inner ends of said compression members contain apertures through which said ring passes transfixing said inner ends, said teeth on said inward extensions engaging each other to orient said ring as said chair is unfolded.

* * * * *